US007914657B2

(12) United States Patent
Fu et al.

(10) Patent No.: US 7,914,657 B2
(45) Date of Patent: Mar. 29, 2011

(54) CONTROLLING THE THICKNESS OF WAFERS DURING THE ELECTROPLATING PROCESS

(75) Inventors: Wai B. Fu, Menlo Park, CA (US); Hieu Lam, Milpitas, CA (US); Shahram Y. Mehdizadeh, Valley Village, CA (US); Yeak-Chong Wong, San Jose, CA (US)

(73) Assignee: Hitachi Global Storage Technologies, Netherlands B.V., Amsterdam (NL)

( * ) Notice: Subject to any disclaimer, the term of this patent is extended or adjusted under 35 U.S.C. 154(b) by 1362 days.

(21) Appl. No.: 11/292,606

(22) Filed: Dec. 1, 2005

(65) Prior Publication Data

US 2007/0125656 A1 Jun. 7, 2007

(51) Int. Cl.
*C25D 21/12* (2006.01)

(52) U.S. Cl. ..... 205/84; 204/228.7

(58) Field of Classification Search ..... 205/84; 204/228.7

See application file for complete search history.

(56) References Cited

U.S. PATENT DOCUMENTS

| | | | | |
|---|---|---|---|---|
| 6,004,440 | A | 12/1999 | Hanson et al. | |
| 6,139,703 | A | 10/2000 | Hanson et al. | |
| 6,168,693 | B1 | 1/2001 | Uzoh et al. | |
| 2004/0115932 | A1 | 6/2004 | Cheng et al. | |
| 2005/0167274 | A1 * | 8/2005 | Wilson et al. | 205/81 |
| 2006/0122728 | A1 * | 6/2006 | Chang et al. | 700/207 |

FOREIGN PATENT DOCUMENTS

| | | |
|---|---|---|
| JP | 61281894 | 12/1986 |
| JP | 117890 | 1/1989 |
| JP | 270099 | 3/1990 |
| JP | 4143299 | 5/1992 |
| JP | 2000178788 | 6/2000 |
| JP | 2003268599 | 9/2003 |

OTHER PUBLICATIONS

Battaglia "Regression-Based Statistical Process Control" AMP Journal of Technology, vol. 3 Nov. 1993 pp. 38ff.

Venkatesan "Performance Analysis of an Integral Controller" International Journal of Production Research, vol. 3 No. 16 2001 pp. 3671-3683.

* cited by examiner

*Primary Examiner* — Alexa D. Neckel
*Assistant Examiner* — Nicholas A. Smith

(57) ABSTRACT

Embodiments of the present invention pertain to controlling thickness of wafers during electroplating process. Information pertaining to an old current used during an electroplating process of a previous wafer is received. Information pertaining to the thickness of the previous wafer is received. A new current is automatically determined. The new current is to be used during an electroplating process for a new wafer. The new current is determined based on the information pertaining to the old current and the information pertaining to the thickness of the previous wafer.

21 Claims, 6 Drawing Sheets

CONTROLLING THE THICKNESS OF WAFERS DURING THE ELECTROPLATING PROCESS

TECHNICAL FIELD

Embodiments of the present invention relate to electroplating wafers. More specifically, embodiments of the present invention relate to controlling the thickness of a wafer while electroplating the wafer.

BACKGROUND

As a part of manufacturing electronic components, such as read write heads, for electronic devices, wafers that the electronic components are made out of are electroplated. In order for a electronic component to function properly, the portion of the wafer that the electronic component is made out of must have an appropriate thickness. Manufacturing uses a "specification" to determine what portions of the wafer have the appropriate thickness. Only the portions of the wafer that have the appropriate thickness can be used to make a electronic component out of.

In the conventional process, a wafer is placed in a vat and electric current is passed through the wafer using deflectors associated with a cathode. FIG. 1 depicts a cathode with a wafer associated with on the cathode. The cathode 110 has 8 deflectors d1-d8 for putting current through the wafer 100. A separate current is put through each deflector d1-d8. The 8 regions r1-r8 correspond to the 8 deflectors d1-d8. The wafer 100 has 8 regions r1-r8 for which current for the corresponding deflector d1-d8 affects the thickness of.

A series of wafers are electroplated in a vat one after another. For example, wafer 1 is electroplated, then wafer 2 is electroplated, then wafer 3 is electroplated and so on. The current that is passed through each of the deflectors d1-d8 is adjusted for each wafer that is electroplated in a vat.

The current that is applied to a deflector, such as deflector d3, associated with a new wafer, such as wafer 4, is calculated based on the current that was applied to the same deflector d3 of the previous wafer, e.g., wafer 3, and the thicknesses at the edge of region r3 and the center of the previous wafer. For the sake of illustration, "i" is a variable that designates the deflector. In the case of a wafer that has 8 deflectors, "i" will vary from 1 to 8. Ri is the thickness of the wafer 100's outer edge for the ith region. Rc is the thickness of the wafer 100 at the center 120.

"Old current i" is the current that was applied to the ith deflector for the previous wafer that was electroplated in a vat. The "old current i" is determined based on the current density and the area of the wafer 100 that is plated (also known as "platting area"). A pattern can be used to specify what area of the wafer 100 is plated and what area of the wafer 100 is not platted.

Ri is the thickness of the previous wafer's outer edge at the ith region. Rc is the thickness of the previous wafer's center. The new current i is the current that will be applied to the ith deflector for the next wafer that will be electroplated in the same vat. Therefore, the new current i for the next wafer is equal to a ratio of the thickness of the outer edge (Ri) and the center (Rc) times the old current i of the previous wafer, where i specifies a particular deflector.

The previous wafer is removed from the vat and the thicknesses at the center (Rc) and at the edges (Ri) that correspond to each of the regions r1-r8 are measured manually. An engineer decides whether to change the current that will be applied to the deflectors for the next wafer using the manually measured thicknesses (Rc and Ris) and the currents "i" for the deflectors of the previous wafer.

FIG. 2 depicts the thickness of various portions of a wafer that results from using the conventional process. As can be seen, the thicknesses 210 range from 2.000 to 2.350 for wafer 100. The wafer 100 is thinnest at the center and thickest at the outer edge. The mean of the thicknesses is 2.2328571 and the standard deviation is 0.1470414.

Therefore, there is a need for a way to increase the amount of the wafer that can be used to manufacture electronic components, among other things.

SUMMARY OF THE INVENTION

Embodiments of the present invention pertain to controlling thickness of wafers during electroplating process. Information pertaining to an old current used during an electroplating process of a previous wafer is received. Information pertaining to the thickness of the previous wafer is received. A new current is automatically determined. The new current is to be used during an electroplating process for a new wafer. The new current is determined based on the information pertaining to the old current and the information pertaining to the thickness of the previous wafer.

BRIEF DESCRIPTION OF THE DRAWINGS

The accompanying drawings, which are incorporated in and form a part of this specification, illustrate embodiments of the invention and, together with the description, serve to explain the principles of the invention.

Figure 1:
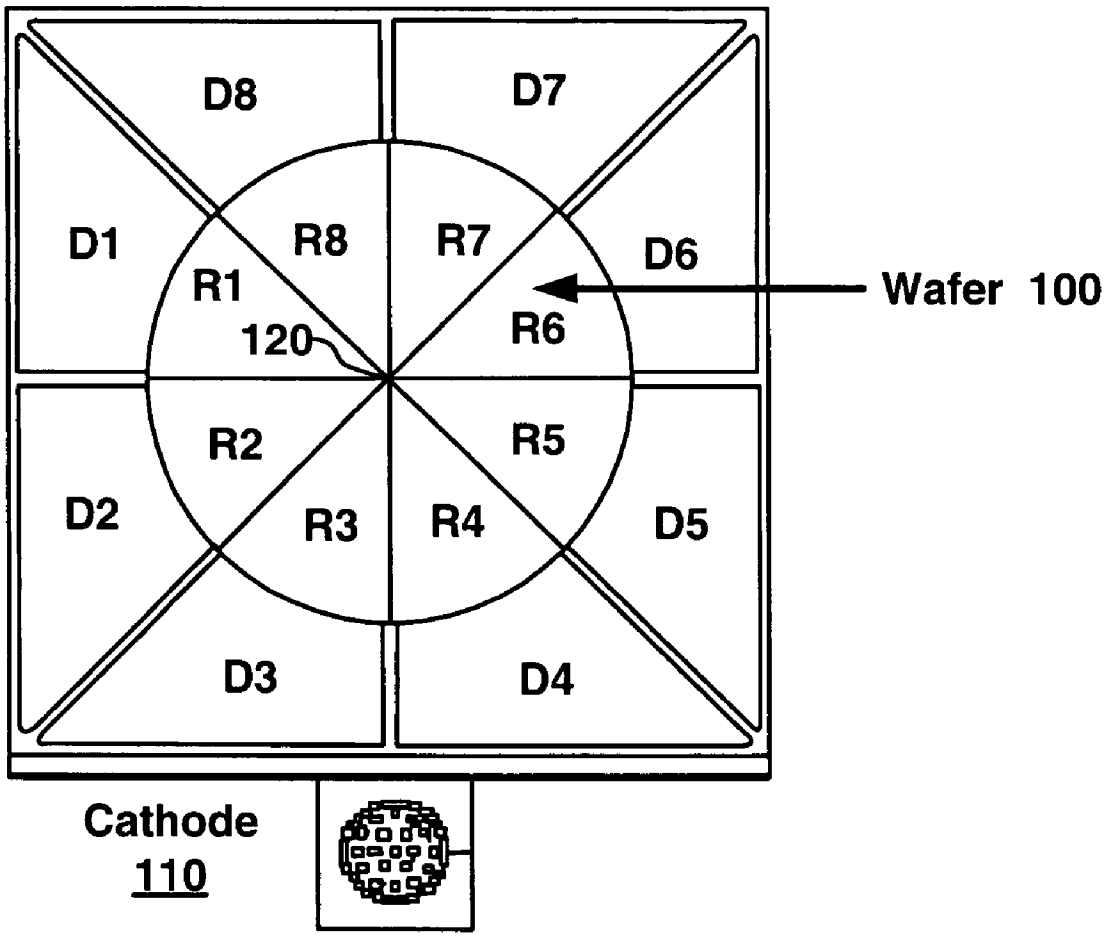
FIG. 1 depicts a cathode with a wafer associated with on the cathode.

The drawings referred to in this description should not be understood as being drawn to scale except if specifically noted.

DETAILED DESCRIPTION

Reference will now be made in detail to various embodiments of the invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description of the present invention, numerous specific details are set forth in order to provide a thorough understanding of the present invention. In other instances, well-known methods, procedures, components, and circuits have not been described in detail as not to unnecessarily obscure aspects of the present invention.

OVERVIEW

With the conventional, a new current is determined manually. According to one embodiment of the present invention, the new current is determined automatically. By determining the new current automatically, manufacturing wafers becomes more efficient and therefore can result in less expensive electronic components.

With the conventional way, a new current is determined based only on data from one previous wafer electroplated in that vat. For example, if wafers 1, 2, 3 are electroplated in a vat one after another, then the new current that is to be applied to a deflector while electroplating wafer 2 is based solely on data from wafer 1. Similarly, the new current that is applied to a deflector while electroplating wafer 3 is based solely on data from wafer 2.

According to another embodiment of the present invention, data from more than one previous wafer that was previously electroplated is used for determining the new current that will be used for electroplating the next wafer that will be electroplated. Continuing the example, the new currents that will be used in electroplating wafer 3 can be based on the thicknesses (at the centers and at each of the regions) and the old currents (applied at each of the deflectors) that were used for electroplating the previous 2 wafers (wafers 1 and 2). By using data from more than one previous wafer that was previously electroplated in a vat, the new current that is to be applied is less likely to overshoot or undershoot a current setting that would result in the best thickness. Therefore, the variability of the thicknesses associated with the wafers made using various embodiments of the present invention in comparison to the variability of thicknesses 210 associated with a conventional wafer 100, as will become more evident. Reducing the variability in the thicknesses results in a higher yield of electronic components for a given number of wafers. A higher yield of electronic components in turns results in lower the cost of manufacturing electronic components.

Device for Controlling Thickness of Wafers During Electroplating Process

Figure 3:
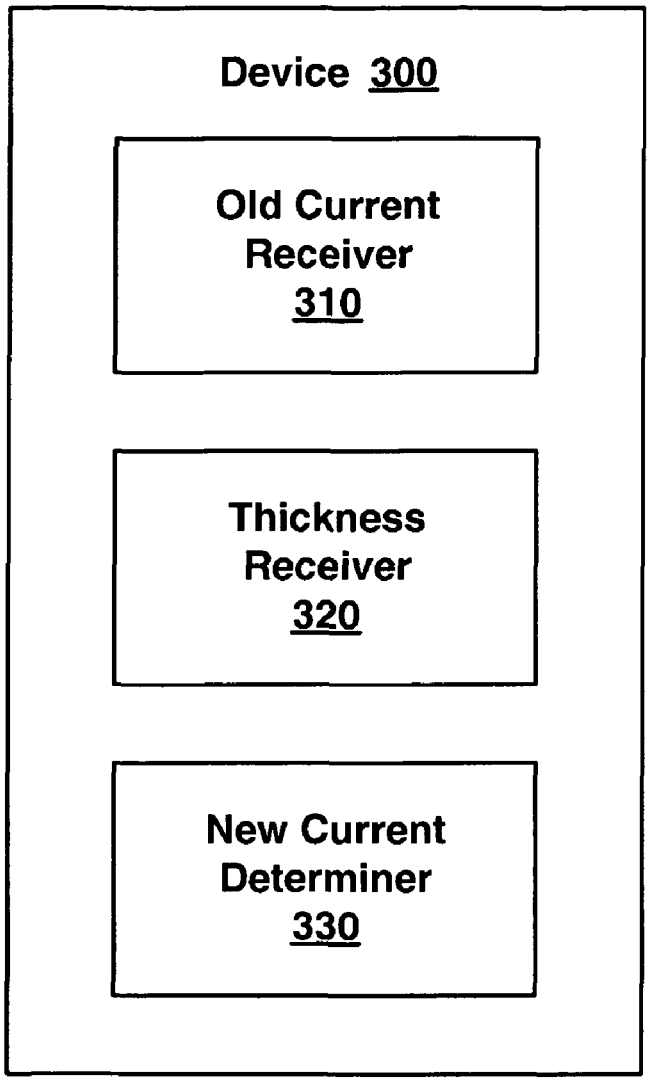
FIG. 3 depicts a block diagram of a device for controlling thickness of wafers during the electroplating process, according to one embodiments of the present invention.

FIG. 3 depicts a block diagram of a device for controlling thickness of wafers during the electroplating process, according to one embodiments of the present invention. The blocks that represent features in FIG. 3 can be arranged differently than as illustrated, and can implement additional or fewer features than what are described herein. Further, the features represented by the blocks in FIG. 3 can be combined in various ways. The device 300 can be implemented using software, hardware, firmware, or a combination thereof.

Device 300 includes an old current receiver 310, a thickness receiver 320, and a new current determiner 330. A vat is used for electroplating a series of wafers. For example, one wafer is electroplated in a vat, then a second wafer is electroplated in the same vat, then a third wafer and so on. Each electroplating process that is performed on the series of wafers is commonly referred to as a "run." For the purpose of illustration, a wafer that is electroplated prior to another wafer shall be referred to as a "previous wafer." The wafer that is electroplated after the "previous wafer" shall be referred to as a "new wafer" or the "next wafer." Two or more wafers that are electroplated before another wafer shall be referred to as "previous wafers." For example, the first, second, and third wafers shall be the "previous wafers" with respect to the fourth wafer.

The old current receiver 310 receives information pertaining to an old current used during an electroplating process of a previous wafer. The thickness receiver 320 receives information pertaining to the thickness of the previous wafer. The new current determiner 330 automatically determines a new current to be used during an electroplating process for a new wafer. The new current determine 330 can determine the new current based on the information pertaining to the old current used for the previous wafer and the thickness of the previous wafer.

According to one embodiment, a new current is determined on a per deflector basis. According to one embodiment, the equation for determining the new currents "i" that are applied to each of the deflectors "i" is $$\text{new current } i = \text{lambda} \times ((Ri/Rc) \times \text{old current } i) + (1 - \text{lambda}) \times \text{old current } i) \quad (1)$$

where "i" is a variable that specifies a particular deflector d1-d8 or a region r1-r8 that corresponds to that particular deflector, lambda is a variable that takes into account data for more than one previous wafer as will become more evident, Rc is the thickness of the previous wafer at the center, and Ri is the thickness of the previous wafer at the edge of the ith region.

For example, assume that the variable "i" specifies a deflector or region that corresponds to that deflector. The thickness of the previous wafer can be measured at the center of the previous wafer and at the edge of the previous wafer for each region i of the previous wafer.

Further, the old current that was applied to the previous wafer can be on a per deflector basis. Therefore, the old current receiver 310 can receive an old current "i" for each deflector i used for the previous wafer and the thickness receiver 320 can receive a thickness for the center of the previous wafer and the thicknesses at the edge of the previous wafer for each region "i" of the previous wafer. Then the new current determiner 330 can automatically determine the new currents "i" that will be applied to the deflectors "i" while electroplating a new wafer based on the old currents "i" for each of the deflectors "i" and the thicknesses measured at the center (Rc) and the edges (Ris). "Ris" refers to all of the thicknesses at the edges for all of the regions "i" of a wafer.

Lambda

As already stated, according to one embodiment, data from more than one wafer that was previously electroplated is used for determining the new current that will be used for electroplating the next wafer that will be electroplated. Lambda is a weighting factor used in equation 1 to calculate exponentially weighted moving average (EWMA) based on thickness data and currents from more than one wafer that was previously electroplated. According to one embodiment, lambda represents weighting factor for calculation of an exponentially weighted moving average (EWMA) of the currents. As is well known in the state of the art of statistics, the value of Lambda is range from 0 to 1.

Deflectors

According to one embodiment, the currents that are applied to deflectors are determined independently. As already described herein, the new current "i" that is applied to a particular deflector "i" for a new wafer can be based on data, such as the old current "i" and thickness Ri, for a deflector "i" for a previous wafer, among other things. For example, the new current that is applied to deflector d1 for a new wafer can be based on the old current that was applied to deflector d1 for a previous wafer and the thickness that was measured at the edge of the previous wafer at region r1.

However, there may be interactions between two adjacent regions, such as region r1 and r2 or region r1 and r8. More specifically, the data gathered for the thickness of the edges of regions r1 and r2 for previous wafers indicate that historically the edge for region r1 tends to be relatively thick and the edge for region r2 tends to be relatively thin. Therefore, the currents that are applied to the deflectors, according to one embodiment, take into account interactions between the regions of a wafer that correspond to those deflectors. For example, the currents that are applied to deflectors d1 and d2 for a new wafer can be adjusted based on the gathered historical data to cause the relative thickness of regions r1 and r2 to even out.

In another example, the relative thickness of a first group of adjoining regions may be relatively thick and the thickness of a second group of adjoining regions may be relatively thin. Assume that the first and second groups may adjoin each other. Therefore, according to one embodiment, the currents that are applied to the deflectors that correspond to the first group of adjoining regions and second group of adjoining regions can be adjusted to cause the relative thickness of the regions to even out. For example, a current A may be applied to all of the deflectors that correspond to the first group of regions and a current B may be applied to all of the deflectors that correspond to the second group of regions. By making current B higher than current A, the thickness of the first group of regions may be decreased and the thickness of the second group of regions may be increased.

Although, the currents that are applied to deflectors are determined independently, two or more of the currents may be the same.

Methods of Controlling Thickness of Wafers During the Electroplating Process

Figure 4:
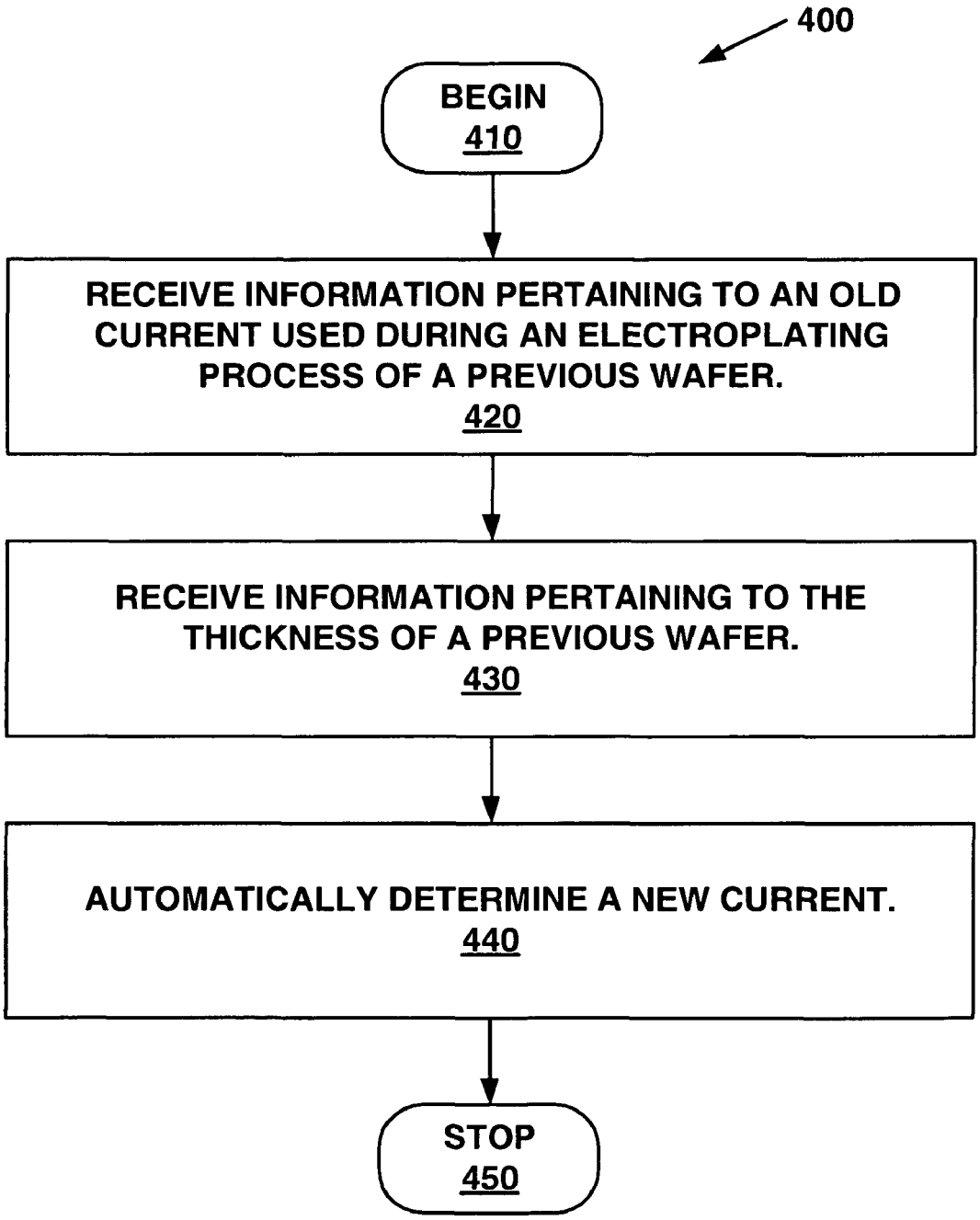
FIG. 4 depicts a flowchart 400 for a method of controlling thickness of wafers during the electroplating process, according to one embodiment.
Figure 5:
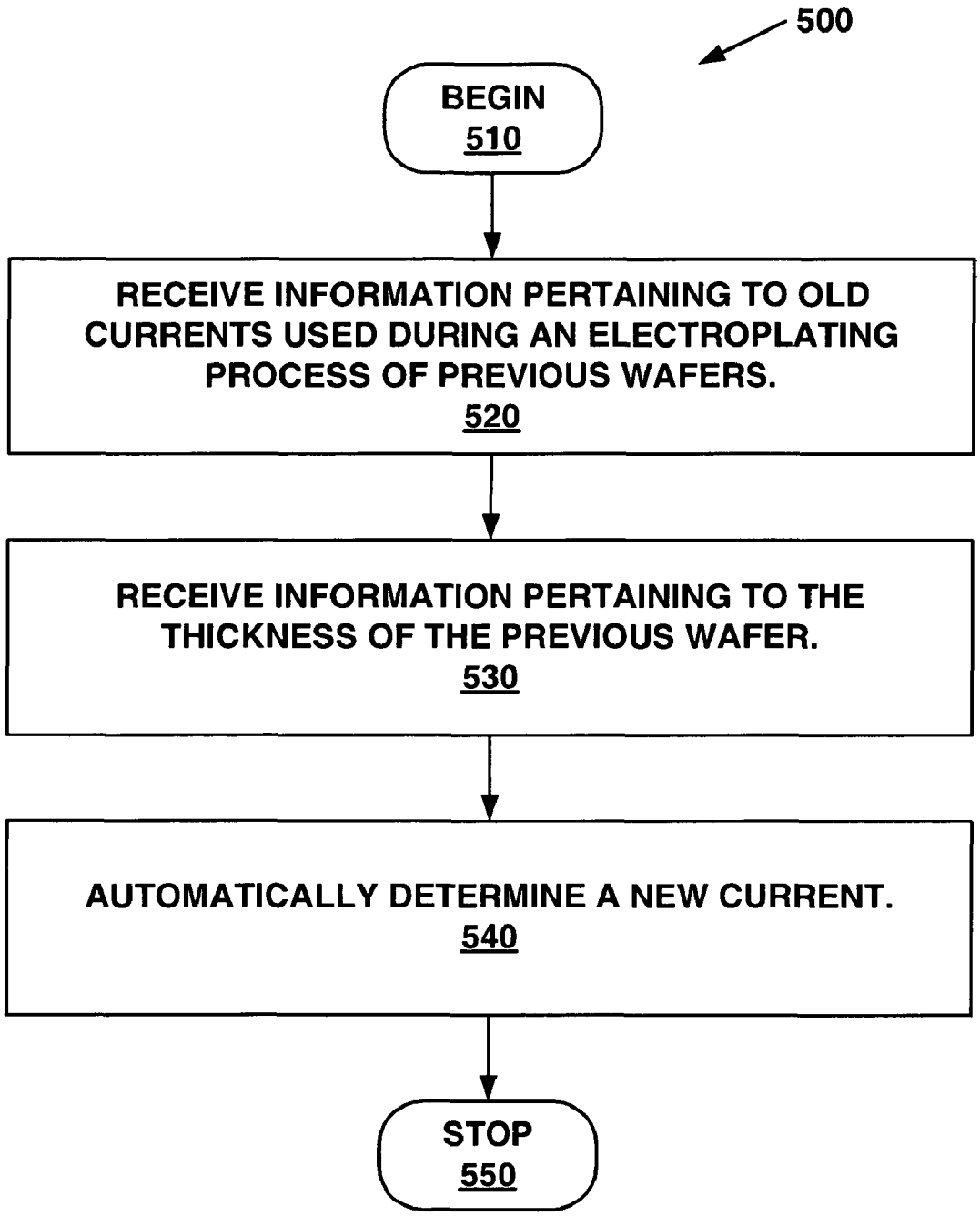
FIG. 5 depicts a flowchart 500 for another method of controlling thickness of wafers during the electroplating process, according to another embodiment.

FIG. 4 depicts a flowchart 400 for a method of controlling thickness of wafers during the electroplating process, according to one embodiment, and FIG. 5 depicts a flowchart 500 for another method of controlling thickness of wafers during the electroplating process, according to another embodiment. Although specific steps are disclosed in flowcharts 400, 500, such steps are exemplary. That is, embodiments of the present invention are well suited to performing various other steps or variations of the steps recited in flowcharts 400, 500. It is appreciated that the steps in flowcharts 400, 500 may be performed in an order different than presented, and that not all of the steps in flowchart 400, 500 may be performed.

For the purposes of illustration, the description of flowcharts 400 and 500 shall refer to FIG. 3 and equation 1. Further, for the purpose of illustration, assume that a series of previous wafers 1-10 have been electroplated in the same vat and wafer 10 has just been taken out of the vat. Preparations are being made to electroplate a new wafer 11 in the same vat. Further, for the purposes of illustration, assume that EWMAs of the old currents that were applied to the deflectors d1-d8 for wafers 1-9 have been calculated. Further, for the purposes of illustration, assume that 8 deflectors are used for electroplating the wafers, thus, the wafers have 8 regions. The variable "i" shall be used for referring to each of the deflectors d1-d8. For the sake of simplicity, flowcharts 400 and 500 shall refer to deflector d1.

In step 410, the process begins.

In step 420, information pertaining to an old current used during an electroplating process of a previous wafer is received. For example, the old current receiver 310 receives the old current that was applied to deflector d1 when electroplating wafer 10. The old current may have been stored, for example, by device 300 and the old current receiver 310 can receive the stored old current. According to one embodiment, an EWMA (lambda) is calculated that takes into account the old current that was applied to deflector d1 for wafer 10.

In step 430, information pertaining to the thickness of the previous wafer is received. For example, when wafer 10 is removed from the vat, the thickness (Rc) of the center and the thickness ($R_1$) at the edge of region r1 is measured. The thickness receiver 320 can receive the thicknesses Rc and $R_1$.

In step 440, a new current is determined automatically. For example, the new current that will be applied to deflector d1 while electroplating wafer 11 is calculated using the old current that was received by current receiver 310 in step 420 (e.g., that was applied to deflector 1) and the thicknesses (Rc and $R_1$) that were received by the thickness receiver 320 in step 430, for example, using equation 1. Note, that since a device 300 is being used for determining the new current, the new current can be determined automatically rather than manually as is the case with the conventional process.

In step 450, the process stops.

According to one embodiment, steps 410-450 determine the new current that is to be applied to a particular deflector 1. Steps 410-450 can be performed in order to determine the new currents that are to be applied to the other deflectors d2-d8 in a manner similar to that described above for deflector d1, for example, until a new current has been determined for each of the deflectors d1-d8.

In step 510, the process begins.

In step 520, information pertaining to old currents used during electroplating process of previous wafers is received. For example, the old current receiver 310 receives the old currents that were applied to deflector d1 when electroplating wafers 1-10. The old currents may have been stored, for example, by device 300 and the old current receiver 310 can receive the stored old currents. According to one embodiment, an EWMA (lambda) is calculated that takes into account the old current that was applied to deflector d1 for wafer 10. Note, that since the EWMA that pertains to deflector d1 for wafer 10 is a weighted moving average that uses the old currents that were applied to deflectors d1 for wafers 1-10, information pertaining to old currents used during electroplating process of previous wafers is received by the old current receiver 310, according to one embodiment.

In step 530, information pertaining to the thickness of a previous wafer is received. For example, when wafer 10 is removed from the vat, the thickness (Rc) of the center and the thickness ($R_1$) at the edge of region r1 is measured. The thickness receiver 320 can receive the thicknesses Rc and $R_1$.

In step 540, a new current is determined. For example, the new current that will be applied to deflector 1 while electroplating wafer 11 is calculated using the old currents that was received by current receiver 310 in step 520 (e.g., that was applied to deflector d1) and the thicknesses (Rc and $R_1$) that were received by the thickness receiver 320 in step 530, for example, using equation 1. According to one embodiment, the EWMA (lambda) that pertains to deflector d1 for wafer 10 is used to determine the new current.

Note, that since the EWMA that pertains to deflector d1 for wafer 10 is a weighted moving average that uses the old currents that were applied to deflectors d1 for wafers 1-10, the new current is determined based on information pertaining to the old currents, according to one embodiment.

Figure 2:
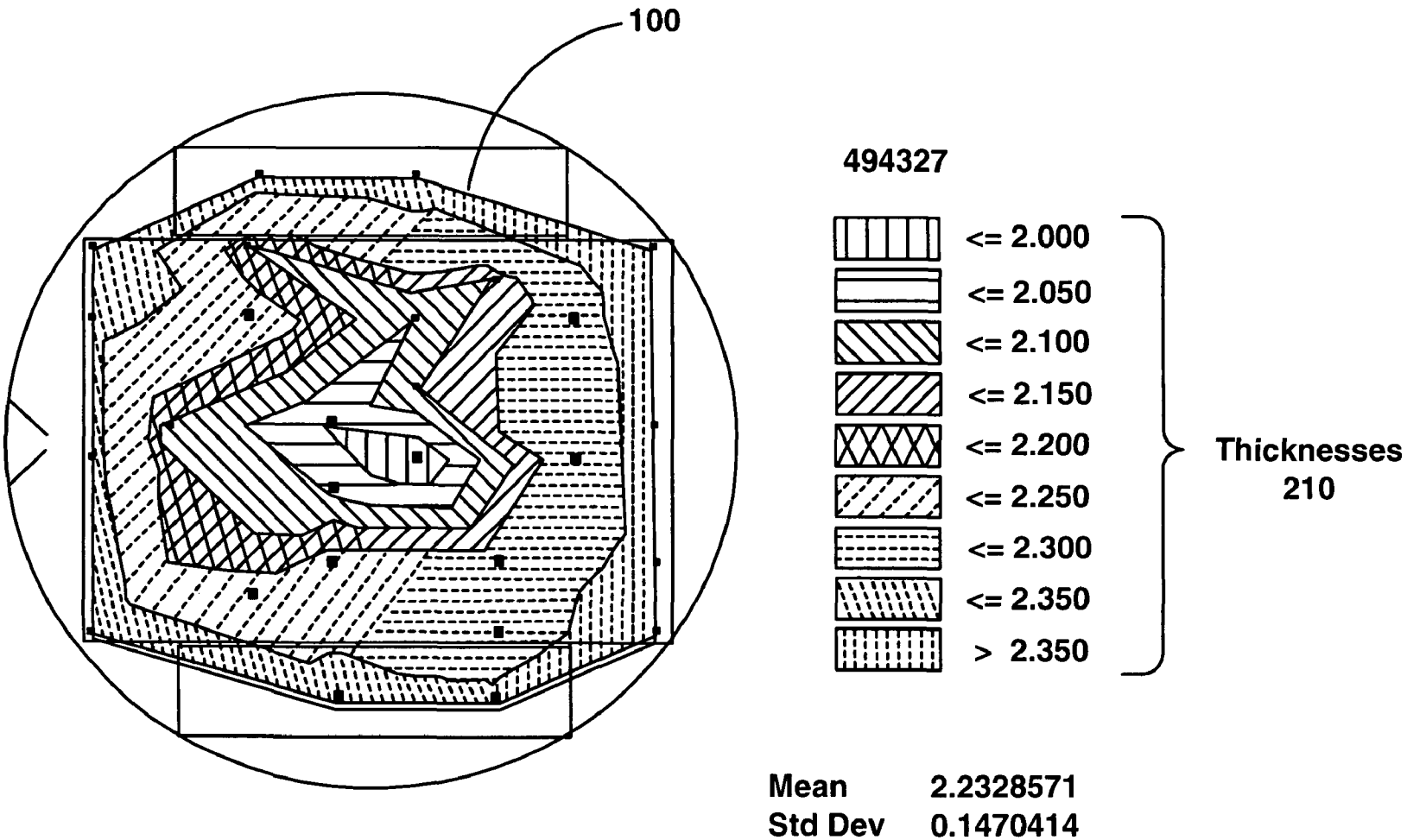
FIG. 2 depicts the thickness of various portions of a wafer that results from using the conventional process.
Figure 6:
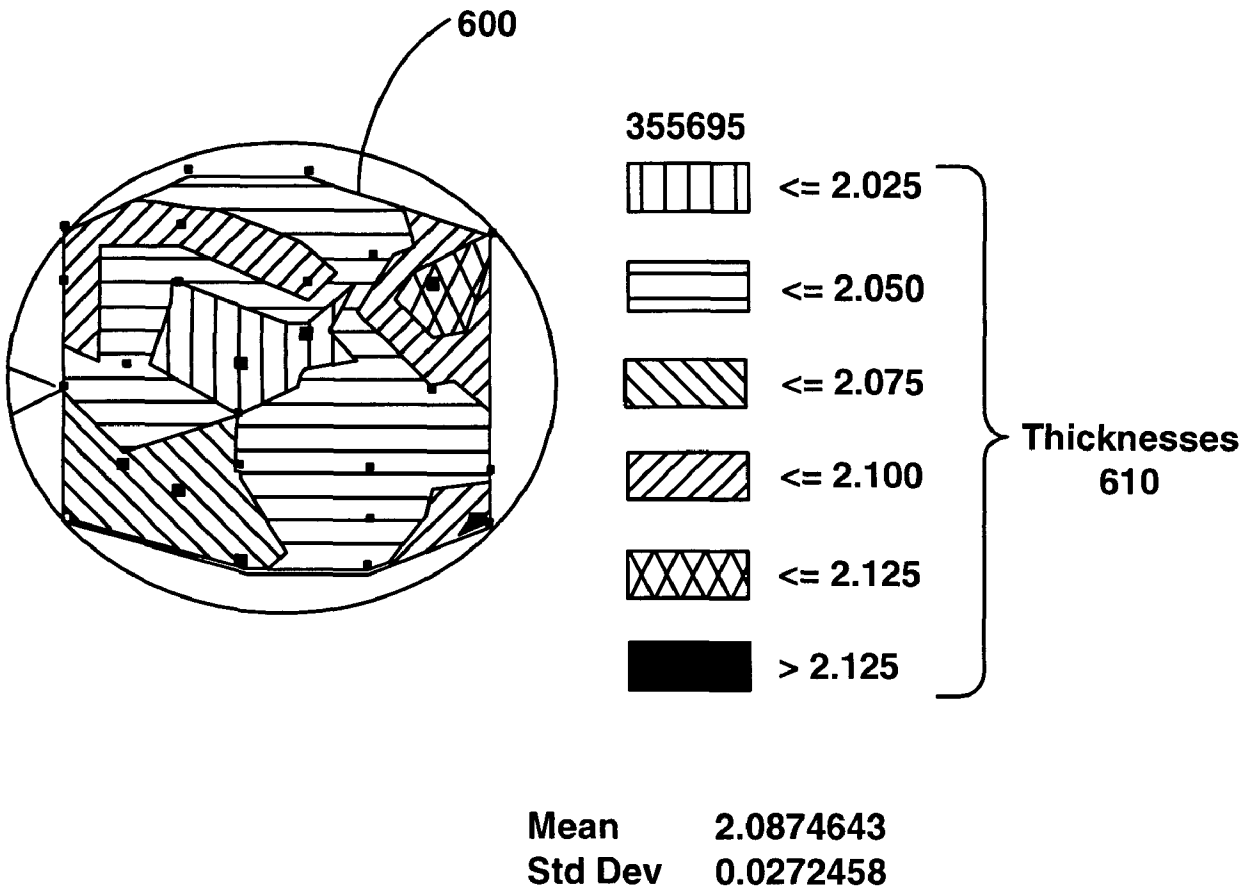
FIG. 6 depicts results using various embodiments of the present invention.

By using method 500 the variability of the thicknesses 610 associated with the new wafer 600 is reduced in comparison to the variability of thicknesses 210 associated with a conventional wafer 100. For example, FIG. 6 depicts results using various embodiments of the present invention. Note that the thickness 610 of various portions of the wafer 600 vary from only 2.025 to 2.125, that the mean is 2.0874643, and the standard deviation is only 0.0272458 in comparison to the results depicted by FIG. 2 for wafer 100. Thus, the various embodiments of the present invention result in significant improvements from the conventional process since the thicknesses 610 across wafer 600 are much more even than thicknesses 210 that result from the conventional process used for wafer 100 (e.g., the variability of the thicknesses 610 associated with wafer 600 is reduced in comparison to the variability of the thicknesses 210 associated with conventional wafer 100). Further, there has been a long felt need for the improved results provided by various embodiments of the present invention.

In step 550, the process stops.

According to one embodiment, steps 510-550 determine the new current that is to be applied to a particular deflector d1. Steps 510-550 can be performed in order to determine the new currents that are to be applied to the other deflectors d2-d8 in a manner similar to that described above for deflector d1, for example, until a new current has been determined for each of the deflectors d1-d8.

What is claimed is:

1. A method of controlling thickness of wafers during electroplating process, the method comprising: receiving information pertaining to an old current used during an electroplating process of a previous wafer; receiving information pertaining to the thickness of the previous wafer, wherein the information pertaining to the thickness includes edge thickness measured at the previous wafer's edge and center thickness measured at the previous wafer's center; automatically determining a new current to be used during an electroplating process for a new wafer, wherein the new current is determined based on a weighted moving average of the information pertaining to the old current using a ratio of the edge thickness and the center thickness of the previous wafer; and electroplating the new wafer using the new current.

2. The method as recited in claim 1, wherein the automatically determining of the new current further comprises:

automatically determining the new current based on data from previous wafers that were electroplated.

3. The method as recited in claim 2, wherein the automatically determining the new current based on the data from the previous wafers that were electroplated further comprises:

using an exponentially weighted moving average (EWMA) of the old currents for the previous wafers to automatically determine the new current.

4. The method as recited in claim 2, wherein the automatically determining of the new current further comprises:

using an equation specifying new current i=lambda×((Ri/Rc)×old current i) (1-lambda)×old current i) where the variable "i" specifies a deflector or a corresponding region of the previous wafer, lambda specifies data from the more than one previous wafers, Ri specifies the thickness of the previous wafer at the edge of a region "i", Rc specifies the thickness of the previous wafer at the center.

5. The method as recited in claim 1, wherein the automatically determining of the new current further comprises:

independently determining new currents that are to be applied to each deflector associated with the new wafer.

6. The method as recited in claim 1, further comprising:

using interactions between regions of the previous wafer as a part of determining new currents that are to be applied to deflectors associated with the new wafer.

7. The method as recited in claim 5, further comprising:

using groupings of regions of the previous wafer as a part of determining new currents that are to be applied to deflectors associated with the new wafer.

8. A system of controlling thickness of wafers during electroplating process, the system comprising: means for receiving information pertaining to old currents used during electroplating process of previous wafers; means for receiving information pertaining to the thickness of a previous wafer, wherein the information pertaining to the thickness includes edge thickness measured at the previous wafer's edge and center thickness measured at the previous wafer's center; and means for reducing variability of the thickness associated with a new wafer in comparison to variability of thickness associated with a conventional wafer by determining a new current to be used during an electroplating process for a new wafer, wherein the new current is determined based on a weighted moving average of the information pertaining to the old current using a ratio of the edge thickness and the center thickness of the previous wafer.

9. The system as recited in claim 8, wherein the system further comprises:

means for automatically determining the new current based on data from the previous wafers that were electroplated.

10. The system as recited in claim 9, wherein the means for automatically determining further comprises:

means for using an exponentially weighted moving average (EWMA) of the old currents for the previous wafers to automatically determine the new current.

11. The system as recited in claim 9, wherein the means for automatically determining of the new current further comprises:

means for using an equation specifying new current i=lambda×((Ri/Rc)×old current i) (1-lambda)×old current i) where the variable "i" specifies a deflector or a corresponding region of the previous wafers, lambda specifies data from the previous wafers, Ri specifies the thickness of the previous wafer at the edge of a region "i", Rc specifies the thickness of the previous wafer at the center.

12. The system as recited in claim 9, wherein the means for automatically determining of the new current further comprises:

means for independently determining new currents that are to be applied to each deflector associated with the new wafer.

13. The system as recited in claim 9, further comprising:

means for using interactions between regions of the previous wafers as a part of determining new currents that are to be applied to deflectors associated with the new wafer.

14. The system as recited in claim 13, further comprising:

means for using groupings of regions of the previous wafers as a part of determining new currents that are to be applied to deflectors associated with the new wafer.

15. A device for controlling thickness of wafers during electroplating process, the device comprising:

old current receiver configured for receiving information pertaining to an old current used during an electroplating process of a previous wafer;

thickness receiver configured for receiving information pertaining to the thickness of the previous wafer, wherein the information pertaining to the thickness includes edge thickness measured at the previous wafer's edge and center thickness measured at the previous wafer's center; and new current determiner configured for automatically determining a new current to be used during an electroplating process for a new wafer, wherein the new current is determined based on a weighted moving average of the information pertaining to the old current using a ratio of the edge thickness and the center thickness of the previous wafer.

16. The device of claim 15, wherein the new current determiner automatically determines the new current based on data from previous wafers that were electroplated.

17. The device of claim 16, wherein the new current determiner uses an exponentially weighted moving average (EWMA) of the old currents for the previous wafers to automatically determine the new current.

18. The device of claim 16, wherein the new current determiner uses an equation specifying new current i=lambda×((Ri/Rc)×old current i) (1-lambda)×old current i) where the variable "i" specifies a deflector or a corresponding region of the previous wafer, lambda specifies data from the more than one previous wafers, Ri specifies the thickness of the previous wafer at the edge of a region "i", Rc specifies the thickness of the previous wafer at the center.

19. The device of claim 15, wherein the new current determiner independently determines new currents that are to be applied to each deflector associated with the new wafer.

20. The device of claim 15, wherein the new current determiner uses interactions between regions of the previous wafer as a part of determining new currents that are to be applied to deflectors associated with the new wafer.

21. The device of claim 19, wherein the new current determiner uses groupings of regions of the previous wafer as a part of determining new currents that are to be applied to deflectors associated with the new wafer.

* * * * *